US007002295B2

(12) United States Patent
Kojima et al.

(10) Patent No.: US 7,002,295 B2
(45) Date of Patent: Feb. 21, 2006

(54) PLASMA DISPLAY DEVICE AND METHOD OF PRODUCING THE SAME

(75) Inventors: Shigeru Kojima, Kanagawa (JP); Toshiharu Suzuki, Kanagawa (JP); Katsuya Shirai, Kanagawa (JP)

(73) Assignee: Sony Corporation, (JP)

( * ) Notice: Subject to any disclaimer, the term of this patent is extended or adjusted under 35 U.S.C. 154(b) by 447 days.

(21) Appl. No.: 10/398,908

(22) PCT Filed: Jul. 17, 2002

(86) PCT No.: PCT/JP02/07253

§ 371 (c)(1),
(2), (4) Date: Apr. 11, 2003

(87) PCT Pub. No.: WO03/017313

PCT Pub. Date: Feb. 27, 2003

(65) Prior Publication Data

US 2004/0095296 A1 May 20, 2004

(30) Foreign Application Priority Data

Aug. 14, 2001 (JP) ..... 2001-245906
May 31, 2002 (JP) ..... 2002-159276

(51) Int. Cl.
*H01J 17/49* (2006.01)

(52) U.S. Cl. ..... 313/582; 313/586

(58) Field of Classification Search ..... 313/581, 313/582, 586, 587
See application file for complete search history.

(56) References Cited

U.S. PATENT DOCUMENTS 6,686,679 B1 * 2/2004 Tuck et al. ..... 313/309

FOREIGN PATENT DOCUMENTS

| | | |
|---|---|---|
| JP | 5-94766 A1 | 4/1993 |
| JP | 5-234519 A1 | 9/1993 |
| JP | 8-236028 A1 | 9/1996 |
| JP | 2001-76629 A1 | 3/2001 |

OTHER PUBLICATIONS

International Search report dated Oct. 29, 2002.

* cited by examiner

*Primary Examiner*—Vip Patel
(74) *Attorney, Agent, or Firm*—Rader, Fishman & Grauer PLLC; Ronald P. Kananen

(57) ABSTRACT

A plasma display device such that fluctuation of discharge start voltage and lowering of luminance would not easily occur, the burning phenomenon of the screen is suppressed, and excellent reliability and long life can be secured, and a method of producing the same, are disclosed. The plasma display device comprises a first panel (10) provided with discharge sustaining electrodes (12) and a dielectric layer (14) on the inside thereof, and a second panel (20) laminated on the first panel (10) so that discharge spaces (4) are formed on the inside of the first panel (10), and the trap density and/or the movable metallic ion density in the dielectric layer (14) is not more than $1\times10^{18}$ pieces/cm$^3$, preferably not more than $1\times10^{17}$ pieces/cm$^3$.

24 Claims, 7 Drawing Sheets

TRAP DENSITY VERSUS LIFE

PLASMA DISPLAY DEVICE AND METHOD OF PRODUCING THE SAME

TECHNICAL FIELD

The present invention relates to a plasma display device and a method of producing the same. More particularly, the present invention relates to a plasma display device having characteristic features as to the trap density and/or the movable metallic ion density of a dielectric film formed on sustaining electrodes or as to the trap density and/or the movable metallic ion density of a dielectric film formed on address electrodes, and a method of producing the same.

BACKGROUND ART

As a picture display device to be used in place of the cathode ray tube (CRT) which constitutes the main stream at present, a variety of flat panel type display devices have been investigated. Examples of such a flat panel type display device include liquid crystal display devices (LCD), electroluminescence display devices (ELD), and plasma display devices (PDP: plasma display panels). Among others, the plasma display devices have such merits as comparative easiness of an increase in screen size and an increase in angle of visibility, excellent durability to environmental factors such as temperature, magnetism, vibration, etc., long useful life and so on, and are expected to be applied not only to wall-hung television sets for home use but also to large type information terminal apparatuses for public viewing.

The plasma display device is a display device in which a voltage is applied to discharge cells containing a discharge gas consisting of a rare gas sealed in discharge spaces, and phosphor layers in the discharge are excited by UV rays generated based on glow discharge in the discharge gas, thereby achieving emission of light. Namely, the individual discharge cells are driven based on a principle similar to that of fluorescent lamps, and a collection of a large number of discharge cells, generally, on the order of several hundreds of thousands of discharge cells constitutes a single display screen. The plasma display devices are generally classified, according to the system of application of voltage to the discharge cells, into the direct current driving type (DC type) and the alternating current driving type (AC type), which have respective merits and demerits.

The AC type plasma display device has the merit that partition walls functioning to partition the individual discharge cells in the display screen may be formed in a stripe form, and is therefore suitable for increasing the definition or fineness. Besides, since the surfaces of the electrodes for discharge are covered with a dielectric layer, the electrodes would not easily be worn, which leads to the merit of long life.

In the AC type plasma display devices commercialized at present, a dielectric layer is provided on sustaining electrodes formed on the inside surface of a first substrate and the dielectric layer is generally constituted of a glass formed by paste printing and firing. In the AC type plasma display device, electric charges are accumulated on the surface of the dielectric layer, and a reverse voltage is applied to the electrodes, whereby the accumulated electric charges are released, to generate a plasma. UV rays are generated by this electric discharge, and the phosphors are excited by the UV rays, to be used for display. In addition, a protective film is provided on the inside surface of the dielectric layer on the side of the discharge spaces.

However, in the AC type plasma display device with the dielectric layer formed by the paste printing method, there is the problem of deterioration of the protective film. As for the causes of the deterioration, it is considered that the film quality of the dielectric layer formed between the protective film and the sustaining electrodes plays an important role. Namely, when the trap density of the dielectric layer is high, electrons or holes are trapped by the traps, to generate an electric potential. Particularly, it is known that in a silicon oxide based dielectric layer, many electron traps due to OH groups are generated. The traps due to the OH groups and the like form electron traps. It is considered that, due to the potential generated by the electrons trapped in the traps, sputtering of the protective layer which is an insulating material proceeds.

Therefore, in the AC type plasma display device in which a thin dielectric layer composed of a low melting point glass is formed by the paste printing method, fluctuation of discharge start voltage or lowering of luminance would easily be generated due to the sputtering of the protective layer, resulting in difficulties on the basis of reliability.

The present invention has been made in consideration of the above circumstances. Accordingly, it is an object of the present invention to provide a plasma display device in which fluctuation of discharge start voltage and lowering of luminance would not easily occur, the burning phenomenon of the screen is suppressed, and which has excellent reliability and long life, and a method of producing the same.

DISCLOSURE OF INVENTION

The present inventors, as a result of their earnest studies for attaining the above object, have found out that when the trap density and/or the movable metallic ion density in the dielectric layer is set to be not more than a predetermined value; the fluctuation of discharge start voltage (driving voltage fluctuation) and the lowering of luminance would not easily be generated, and the reliability and life are enhanced. Based on the finding, the present invention has been completed. It is considered that the fluctuation of discharge start voltage (driving voltage fluctuation) and the lowering of luminance would not easily occur and the reliability and life are enhanced when the trap density and/or the movable metallic ion density in the dielectric layer is set to be not more than a predetermined value, because under this condition the sputtering of the protective film due to the potential generated by the electrons trapped in the traps can be obviated. Or, it is considered that the reason is that where the film quality of the dielectric layer is thus enhanced, the amount of the electric charges trapped in the dielectric layer is reduced, and the influence of the potential generated by the trapped electric charges can be reduced.

In addition, the present inventors have found out that when the trap density and/or the movable metallic ion density in the dielectric layer is set to be not more than a predetermined value, it is possible to prevent the fluctuation of voltage according to the position in the screen, which is considered to be a cause of the burning phenomenon of the screen.

In accordance with a first aspect of the present invention, there is provided a plasma display device comprising a first panel provided with a discharge sustaining electrode and a dielectric layer on the inside thereof, and a second panel laminated on the first panel so that a discharge space is formed on the inside of the first panel, wherein the trap density in the dielectric layer is not more than $1\times10^{18}$ pieces/$cm^3$.

In accordance with a second aspect of the present invention, there is provided a plasma display device comprising a first panel provided with a discharge sustaining electrode and a dielectric layer on the inside thereof, and a second panel laminated on the first panel so that a discharge space is formed on the inside of the first panel, wherein the movable metallic ion density in the dielectric layer is not more than $1\times10^{18}$ pieces/cm$^3$.

In the present invention, preferably, where the trap density in the dielectric layer is not more than $1\times10^{18}$ pieces/cm$^3$ or the movable metallic ion density in the dielectric layer is not more than $1\times10^{18}$ pieces/cm$^3$, the electric field strength impressed on the dielectric layer is not more than $7\times10^4$ V/cm.

Or, a condition may be adopted in which the following relational formula (1):

$$\text{Log } N \leqq -E\cdot10^{-4}/23+18+7/23 \quad (1)$$

is satisfied, where E is the electric field strength impressed on the dielectric layer, and N is the trap density or movable metallic ion density in the dielectric layer.

Namely, it is possible to set the electric field strength to be comparatively low and to reduce largely the amount itself of electric charges injected into the dielectric layer by, for example, setting the thickness of the dielectric layer to be as large as about 20 to 40 $\mu$m. As a result, the generation of a negative potential due to the injected electric charges can be restrained, and acceleration of the sputtering of the protective layer can be prevented. In addition, fluctuation of the electric charge distribution can be restrained. Besides, by setting the electric field strength impressed on the dielectric layer to be low, fluctuation of the in-film distribution of the electric charges already injected into the dielectric layer can also be obviated. Therefore, it suffices to set the trap density in the dielectric layer to be not more than $1\times10^{18}$ pieces/cm$^3$ or to set the movable metallic ion density in the dielectric layer to be not more than $1\times10^{18}$ pieces/cm$^3$.

In addition, in the present invention, it is preferable that the trap density in the dielectric layer is not more than $1\times10^{17}$ pieces/cm$^3$ or the movable metallic ion density in the dielectric layer is not more than $1\times10^{17}$ pieces/cm$^3$.

In this case, it is preferable that the electric field strength impressed on the dielectric layer is not more than $30\times10^4$ V/cm. Namely, where the thickness of the dielectric layer is as small as not more than 20 $\mu$m, further, not more than 10 $\mu$m, particularly not more than 7 $\mu$m, the electric field strength becomes high, and, in that case, it is preferable that the trap density in the dielectric layer is not more than $1\times10^{17}$ pieces/cm$^3$ or the movable metallic ion density in the dielectric layer is not more than $1\times10^{17}$ pieces/cm$^3$.

Preferably, the trap density in the dielectric layer is not more than $1\times10^{17}$ pieces/cm$^3$ and not less than $1\times10^9$ pieces/cm$^3$, and more preferably not more than $5\times10^{16}$ pieces/cm$^3$. In the present invention, it is more preferable that the trap density and/or the movable metallic ion density is lower, but the lower limit thereof is restricted due to limitations arising from the production method and the like.

It is preferable that a barrier layer having a thickness of several nm to several tens of nm is provided between a bus electrode formed along the longitudinal direction of the discharge sustaining electrode and the dielectric layer, for preventing the diffusion of metal from the bus electrode into the dielectric layer or for preventing the injection of carriers. The provision of the barrier layer has the effect of preventing the diffusion of the metallic ions into the dielectric layer, thereby preventing the movable metallic ion density in the dielectric layer from increasing. For example, such metals as Ag, Na, Cr, Cu, Co, Fe, and Ni are liable to become movable ions. Therefore, in the case where the dielectric layer composed of a low melting point glass or the like is formed on the inside of the bus electrode consisting of a metallic electrode by a coating and firing method, it is preferable to provide the barrier layer, for preventing the diffusion of the metal from the bus electrode. As the barrier layer, for example, a film of silicon oxynitride (SiON), which is a nitrogen-containing silicon oxide, a film of titanium nitride (TiN) or the like is used.

Preferably, a protective film is provided on the surface of the dielectric layer on the side of the discharge space, and a barrier layer having a thickness of about several nm to several tens of nm may be provided between the dielectric layer and the protective film for the purpose of suppressing the injection of carriers into the dielectric layer. The barrier layer is constituted, for example, of an SiON film.

Preferably, the dielectric layer is a film of $SiO_{2-x}$ (where x is in the range of $0\leqq x<1.0$) formed by a vacuum film forming method or a CVD method. Alternatively, the dielectric layer is a film of nitrogen-containing silicon oxide (SiON) formed by a vacuum film forming method or a CVD method. These silicon oxide films are liable to be films having the trap density of not more than $1\times10^{17}$ pieces/cm$^3$.

Incidentally, the dielectric layer may be a glass paste dielectric film formed by a coating method, a printing method or a dry film method, followed by firing. Or, the dielectric layer may be an oxide or nitride dielectric film formed by a chemical vapor phase method. Or, the dielectric layer may be a nitrogen-containing oxide dielectric film formed by a chemical vapor phase method.

The plasma display device according to the present invention is preferably an alternating current driving type plasma display device, in which an address electrode, the partition walls for partitioning the discharge space, and a phosphor layer disposed between the partition walls are provided on the inside of the second panel.

Preferably, a dielectric film is provided on the inside on the discharge space side of the address electrode, and the trap density in the dielectric film is not more than $1\times10^{18}$ pieces/cm$^3$ (more preferably, not more than $1\times10^{17}$ pieces/cm$^3$).

Preferably, the dielectric film is provided on the inside on the discharge space side of the address electrode, and the movable metallic ion density in the dielectric film is not more than $1\times10^{18}$ pieces/cm$^3$ (more preferably, not more than $1\times10^{17}$ pieces/cm$^3$)

As for the address discharge (data write discharge) by the address electrode, also, the same thing as that for the pair of discharge sustaining electrodes can be said. Therefore, it is preferable that the trap density and/or the movable metallic ion density in the dielectric film formed on the inside of the address electrode is the same or similar to that in the dielectric layer laminated on the discharge sustaining electrode.

In accordance with a first aspect of the present invention, there is provided a method of producing a plasma display device comprising a first panel provided with a discharge sustaining electrode and a dielectric layer on the inside thereof, and a second panel laminated on the first panel so that a discharge space is formed on the inside of the first panel, wherein the dielectric layer is comprised of a silicon oxide film formed by a sputtering method in which the partial pressure of oxygen gas in an atmosphere gas introduced into a sputtering apparatus is not less than 15%, to thereby form the dielectric layer having the trap density of not more than $1\times10^{18}$ pieces/cm$^3$ (preferably, not more than $1\times10^{17}$ pieces/cm$^3$). As the atmosphere gas, a gas containing an inert gas such as argon gas as a main constituent is used.

In accordance with another aspect of the present invention, there is provided a method of producing a plasma display device comprising a first panel provided with a discharge sustaining electrode and a dielectric layer on the inside thereof, and a second panel laminated on the first panel so that a discharge space is formed on the inside of the first panel, wherein the dielectric layer is comprised of an oxide film formed by a chemical vapor phase method in which the substrate temperature is in the range of 350 to 630° C., inclusive, to thereby form the dielectric layer having the trap density of not more than $1\times10^{18}$ pieces/cm$^3$.

In accordance with a further aspect of the present invention, there is provided a method of producing a plasma display device comprising a first panel provided with a discharge sustaining electrode and a dielectric layer on the inside thereof, and a second panel laminated on the first panel so that a discharge space is formed on the inside of the first panel, wherein the dielectric layer is comprised of a low melting point glass film formed by a method in which firing is conducted at a film formation temperature in the range of 500 to 630° C., inclusive, to thereby form the dielectric layer having the trap density of not more than $1\times10^{18}$ pieces/cm$^3$.

In accordance with yet another aspect of the present invention, there is provided a method of producing a plasma display device comprising a first panel provided with a discharge sustaining electrode and a dielectric layer on the inside thereof, and a second panel laminated on the first panel so that a discharge space is formed on the inside of the first panel, wherein a dielectric film is provided on the inside on the discharge space side of the address electrode in the second panel, and the dielectric layer is comprised of a low melting point glass film formed by a method in which firing is conducted at a film formation temperature in the range of 500 to 630° C., inclusive, to thereby form the dielectric layer having the trap density of not more than $1\times10^{18}$ pieces/cm$^3$.

In the present invention, the trap density of the dielectric layer can be measured, for example, by a method in which the dielectric layer to be measured and metallic electrodes are formed on the surface of a semiconductor such as a doped Si substrate, and the trap density is measured from the hysteresis generated by bias application in CV (capacity-voltage) measurement. In addition, in the present invention, the movable metallic ion density in the dielectric layer can be measured, for example, by the BT (electric field-temperature) stress method.

BEST MODE FOR CARRYING OUT THE INVENTION

Figure 1:
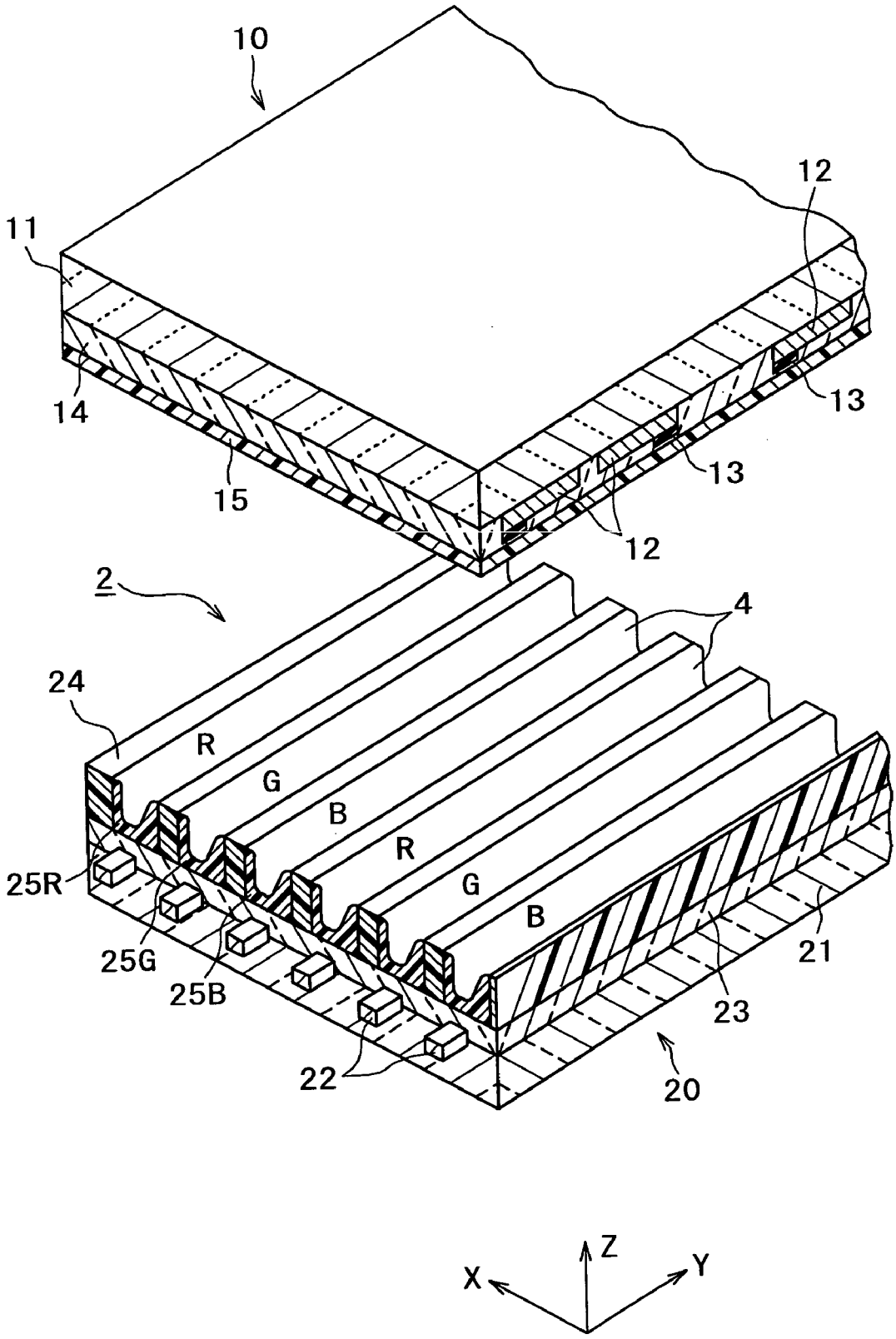
FIG. 1 is a general sectional view of a major part of a plasma display device according to one embodiment of the present invention.

Now, the present invention will be described below based on embodiments shown in the drawings.

Figure 2:
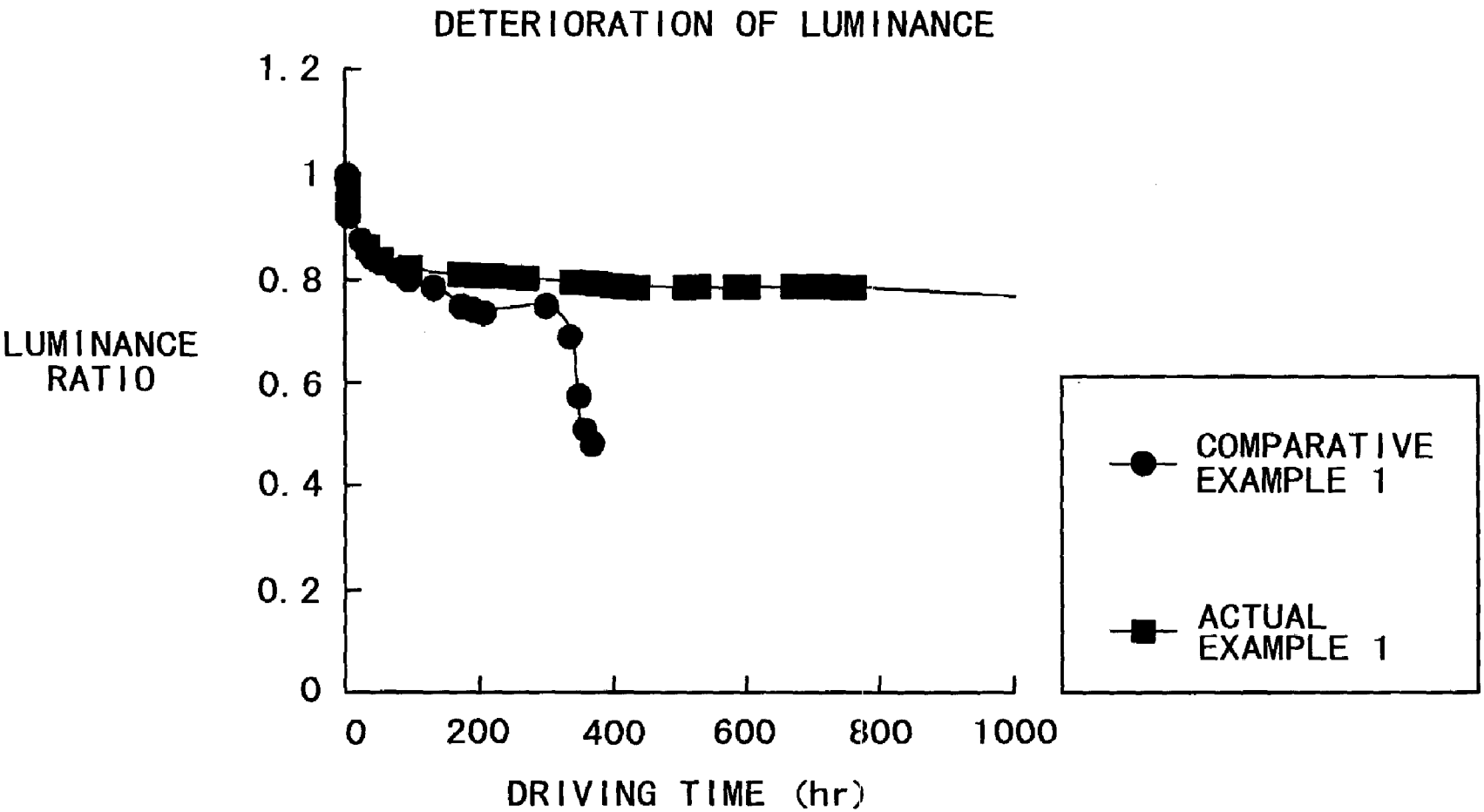
FIG. 2 is a graph showing the deterioration of luminance of plasma display devices according to an example of the present invention and a comparative example.
Figure 3:
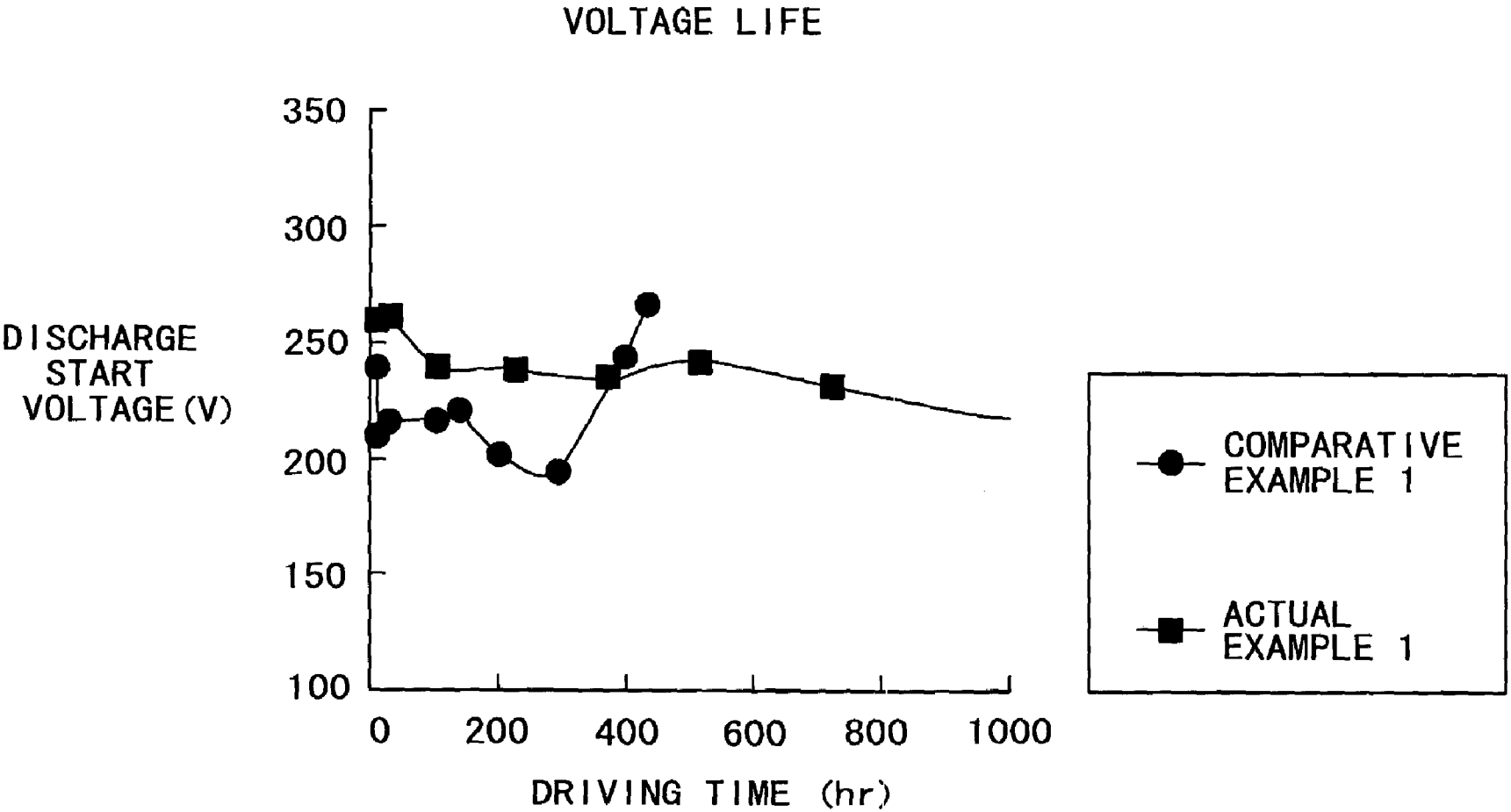
FIG. 3 is a graph showing the voltage life of the plasma display devices according to the example of the present invention and the comparative example.
Figure 4:
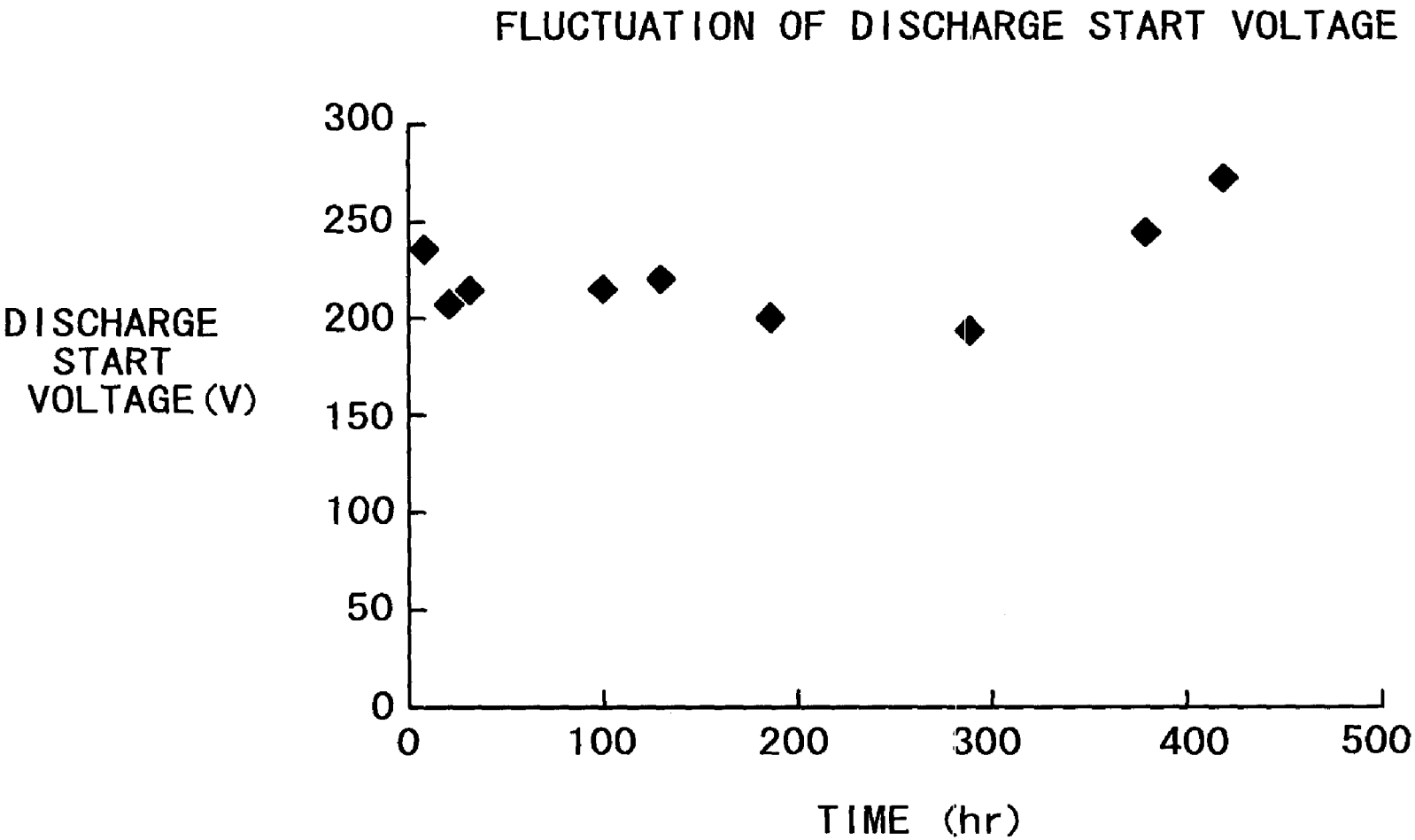
FIG. 4 is a graph showing the fluctuation of discharge start voltage of a plasma display device according to another embodiment of the present invention.
Figure 5:
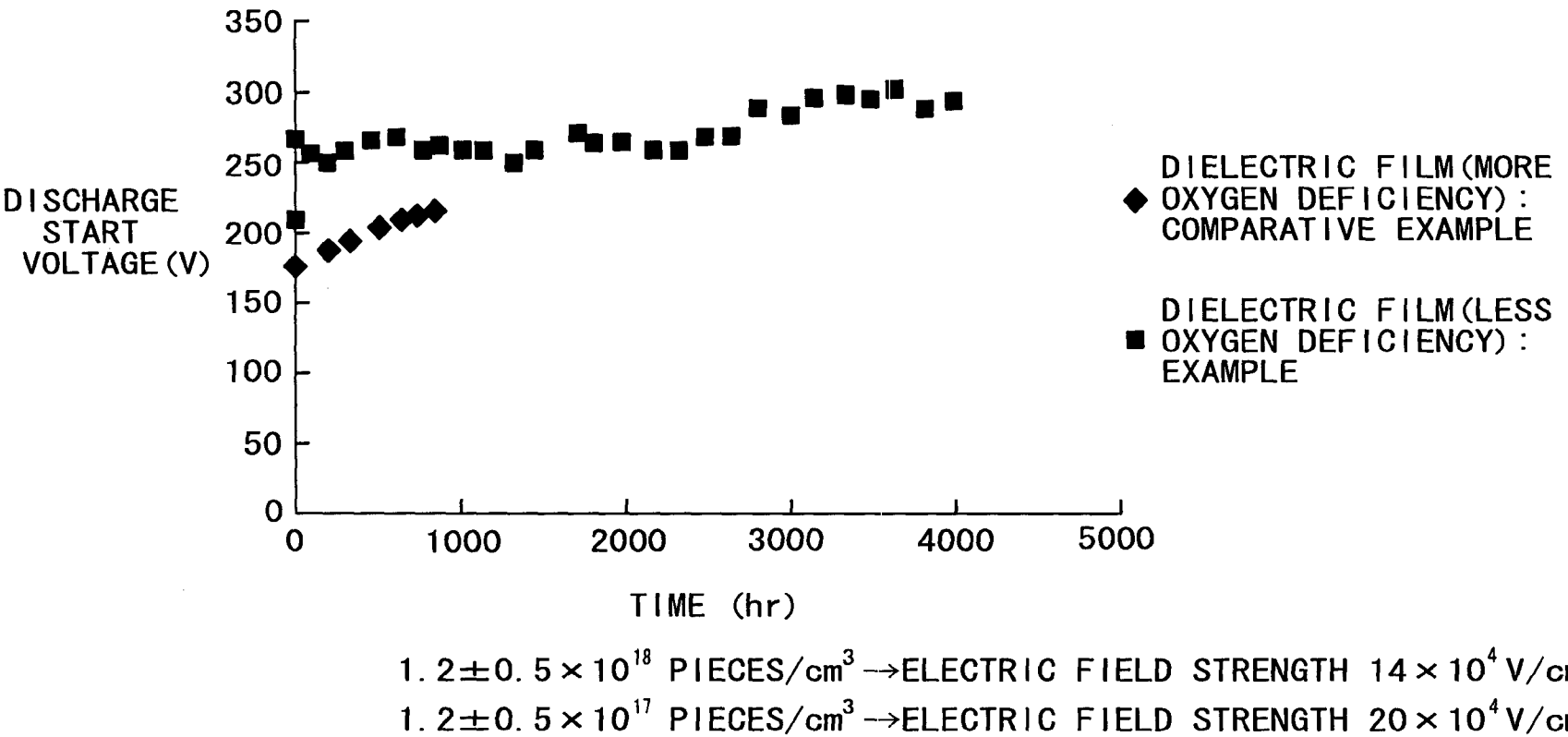
FIG. 5 is a graph showing the relationship between trap density versus life test, in plasma display devices according to another example of the present invention and a comparative example.
Figure 6:
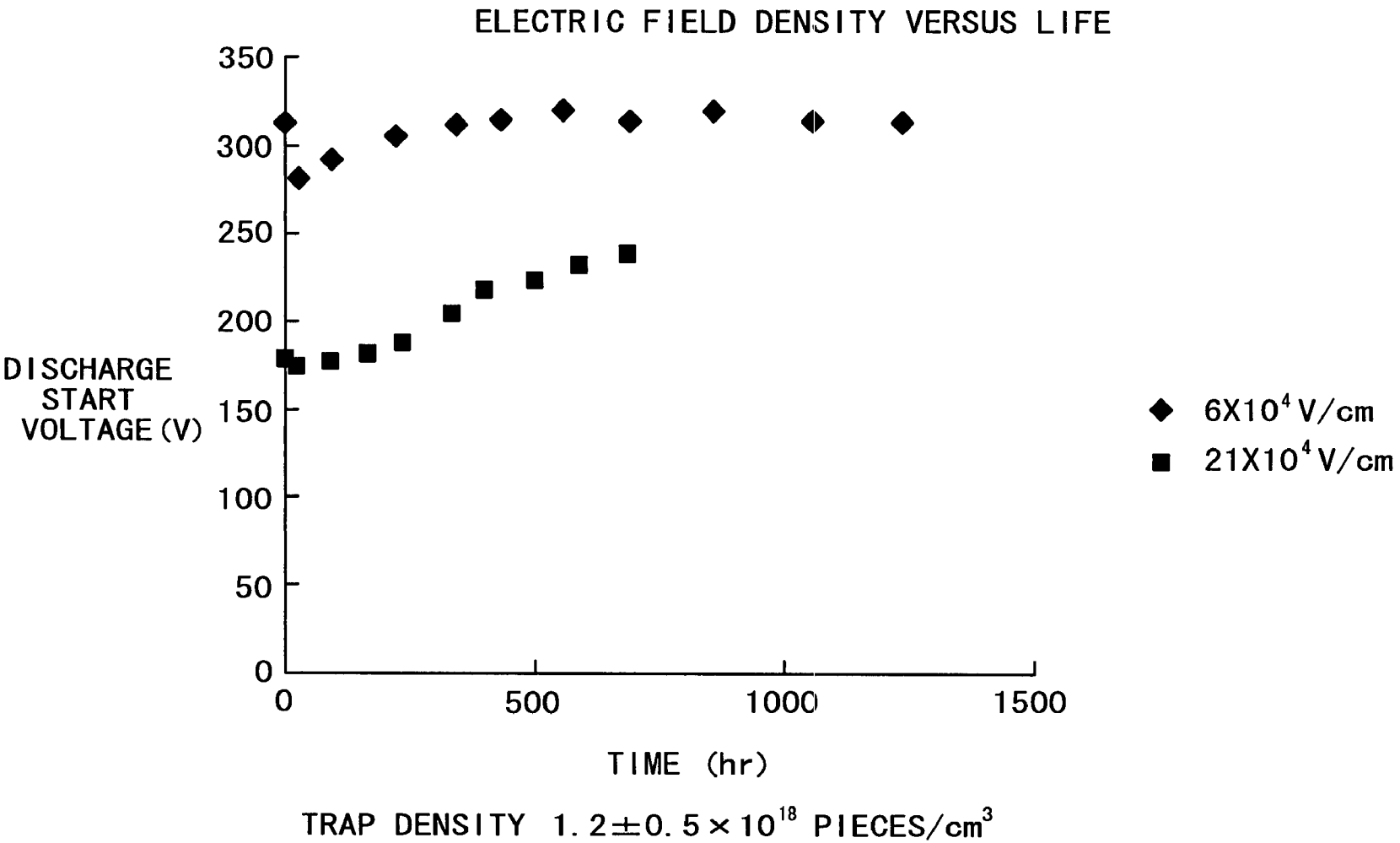
FIG. 6 is a graph showing the relationship between electric field strength versus life test, in the plasma display device according to a comparative example of the present invention.
Figure 7:
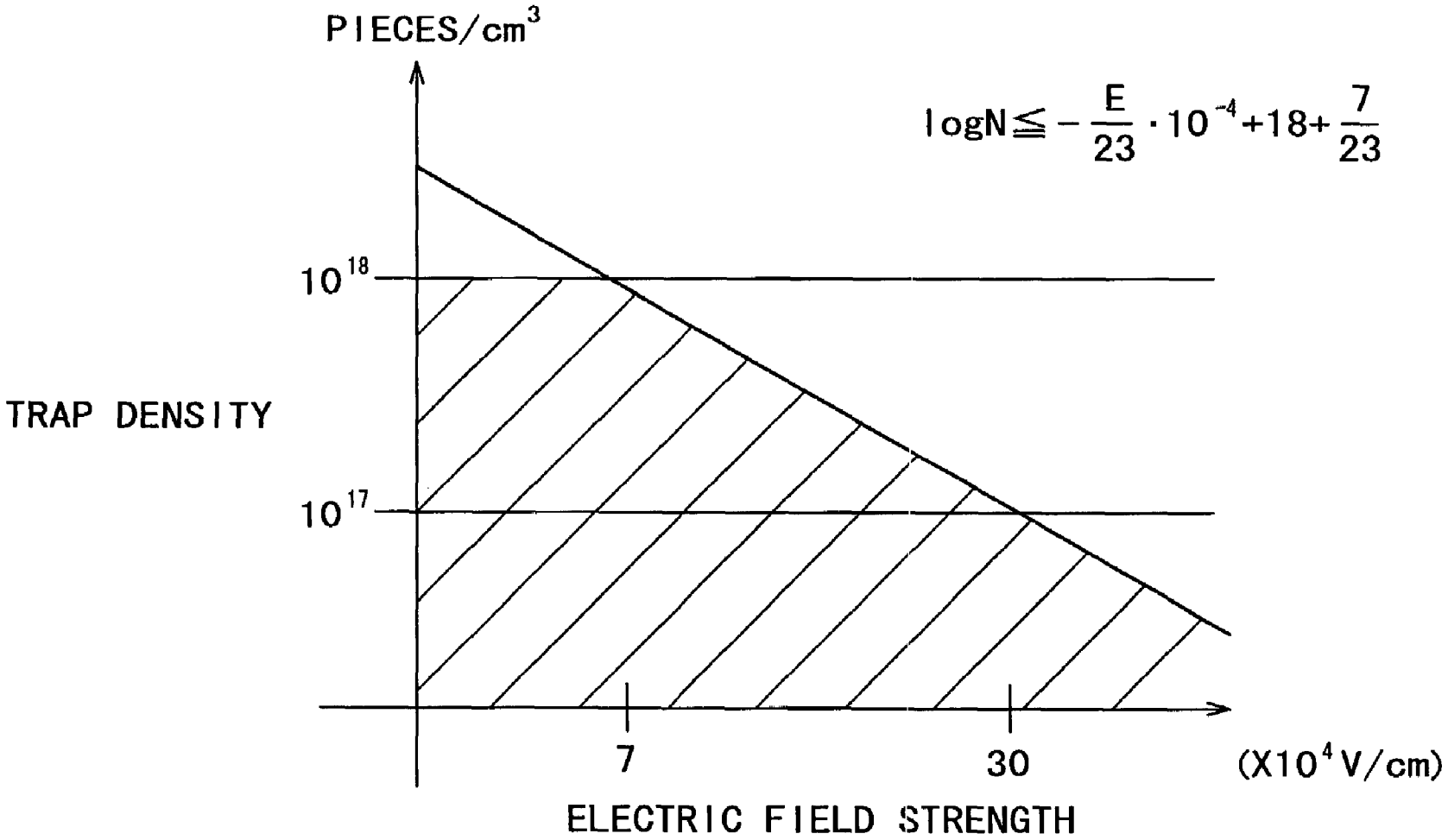
FIG. 7 is a graph showing the relationship between electric field strength versus trap density in the plasma display device according to the present invention.

FIG. 1 is a general sectional view of a major part of a plasma display device according to one embodiment of the present invention; FIG. 2 is a graph showing the deterioration of luminance of plasma display devices according to an example of the present invention and a comparative example; FIG. 3 is a graph showing the voltage life of plasma display devices according to the example of the present invention and the comparative example; FIG. 4 is a graph showing the fluctuation of discharge start voltage of a plasma display device according to another embodiment of the present invention; FIG. 5 is a graph showing the relationship between trap density versus life test in the plasma display device according to another example of the present invention; FIG. 6 is a graph showing the relationship between electric field strength versus life test in the plasma display device according to the example of the present invention; and FIG. 7 is a graph showing the relationship between electric field strength versus trap density in the plasma display device according to the present invention.

First Embodiment

General Constitution of Plasma Display Device

First, based on FIG. 1, the general constitution of an alternating current type (AC type) plasma display device (hereinafter sometimes referred to simply as a plasma display device) will be described.

An AC type plasma display device 2 shown in FIG. 1 belongs to the so-called three-electrode type, and electric discharge occurs between a pair of discharge sustaining electrodes 12. The AC type plasma display device 2 comprises a first panel 10 corresponding to a front panel, and a second panel 20 corresponding to a rear panel, which are laminated on each other. Light emission of phosphor layers 25R, 25G, 25B on the second panel 20 is observed, for example, through the first panel 10. Namely, the first panel 10 is on the display surface side.

The first panel 10 is comprised of a transparent first substrate 11, a plurality of pairs of discharge sustaining electrodes 12 provided in a stripe form on the first substrate 11 and formed of a transparent conductive material, bus electrodes 13 provided for lowering the impedance of the discharge sustaining electrodes 12 and formed of a material having an electric resistivity lower than that of the discharge sustaining electrodes 12, a dielectric layer 14 provided on the first substrate 11 inclusive of the areas on the bus electrodes 13 and the discharge sustaining electrodes 12, and a protective layer 15 provided on the dielectric layer 14. Incidentally, the protective layer 15 may not necessarily be provided but is preferably provided.

On the other hand, the second panel 20 is comprised of a second substrate 21, a plurality of address electrodes (called also "data electrodes") 22 provided in a stripe form on the second substrate 21, a dielectric film 23 provided on the second substrate 21 inclusive of the areas on the address electrodes 22, insulating partition walls 24 provided on the dielectric layer 23 in the regions between the adjacent address electrodes 22, and a phosphor layer provided over the range from the region on the dielectric film 23 to the regions on the side wall surfaces of the partition walls 24. The phosphor layer is comprised of red phosphor layers 25R, green phosphor layers 25G, and blue phosphor layers 25B.

FIG. 1 is a partially exploded perspective view of the display device; in practice, top portions of the partition walls 24 on the side of the second panel 20 are in contact with the protective layer 15 on the side of the first panel 10. The region where one pair of the discharge sustaining electrodes 12 overlap with the address electrode 22 located between two partition walls 24 corresponds to a single discharge cell. A discharge gas is sealed in each discharge space 4 surrounded by the adjacent partition walls 24, the phosphor layer 25R, 25G or 25B, and the protective layer 15. The first panel 10 and the second panel 20 are jointed to each other at their peripheral portions, by use of a frit glass.

The discharge gas sealed in the discharge spaces 4 is not particularly limited, and an inert gas such as xenon (Xe) gas, neon (Ne) gas, helium (He) gas, argon (Ar) gas, nitrogen ($N_2$) gas, etc., or a mixture gas of these inert gases is used as the discharge gas. The total pressure of the discharge gas (gases) sealed in is not particularly limited, and is about $6\times10^3$ Pa to $8\times10^4$ Pa.

The direction in which a projection image of the discharge sustaining electrode 12 extends and the direction in which a projection image of the address electrode 22 extends are roughly orthogonal (may not necessarily be orthogonal) to each other, and the region in which one pair of the discharge sustaining electrodes 12 overlap with one set of the phosphor layers 25R, 25G, 25B for emitting light in three primary colors corresponds to one pixel. Since glow discharge occurs between the pair of the discharge sustaining electrodes 12, this type of plasma display device is called "the plane discharge type". A driving method for this plasma display device will be described later.

The plasma display device 2 according to this embodiment is the so-called reflection-type plasma display device, and the light emission of the phosphor layers 25R, 25G, 25B is observed through the first panel 10. Therefore, though the conductive material constituting the address electrodes 22 may be either transparent or opaque, the conductive material constituting the discharge sustaining electrodes 12 must be transparent. Here, the term "transparent" and "opaque" are used on the basis of the light transmission property of a conductive material at the light emission wavelengths (in the visible region) peculiar to the phosphor layer materials. Namely, the conductive material constituting the discharge sustaining electrodes or the address electrodes can be said to be transparent if the conductive material is transparent to the rays emitted from the phosphor layers.

As the opaque conductive material, there can be used such materials as Ni, Al, Au, Ag, Al, Pd/Ag, Cr, Ta, Cu, Ba, $LaB_6$, $Ca_{0.2}La_{0.8}CrO_3$, etc., either singly or in appropriate combination. Examples of the transparent conductive material include ITO (indium tin oxide) and $SnO_2$. The discharge sustaining electrodes 12 or the address electrodes 22 can be formed by a sputtering method, a vapor deposition method, a screen printing method, a plating method or the like, and are patterned by a photolithography method, a sandblasting method, a lift-off method or the like. The electrode width of the discharge sustaining electrodes 12 is not particularly limited, and is about 200 to 400 $\mu$m. The spacing between the pair of the electrodes 12 is not particularly limited, and is preferably about 5 to 150 $\mu$m. The width of the address electrodes 22 is, for example, about 50 to 100 $\mu$m.

The bus electrodes 13 can typically be constituted of a metallic material such as, for example, a single-layer metallic film of Ag, Au, Al, Ni, Cu, Mo, Cr or the like, or a laminate film of Cr/Cu/Cr or the like. The bus electrodes 13 composed of such a metallic material, in the reflection-type plasma display device, may reduce the transmission light amount of visible rays emitted from the phosphor layers and transmitted through the first substrate 11, and may thereby cause a lowering in the luminance of the display screen. Therefore, it is preferable that the bus electrodes 13 are formed to be as thin as possible, in such a range that an electric resistance required of the entire body of the discharge sustaining electrodes can be obtained. In concrete, the electrode width of the bus electrodes 13 is smaller than that of the discharge sustaining electrodes 12, and is, for example, about 30 to 200 $\mu$m. The bus electrodes 13 can be formed by a method similar to those for the discharge sustaining electrodes 12 and the like.

The dielectric layer 14 provided on the surfaces of the discharge sustaining electrodes 12, in this embodiment, is composed of a single layer of silicon oxide ($SiO_{2-x}$ ($0\leqq x<1.0$)), and the trap density thereof is not more than $1\times10^{17}$ pieces/cm$^3$. In addition, the movable metallic ion density in the dielectric layer 14 is not more than $1\times10^{17}$ pieces/cm$^3$. Incidentally, in order to suppress an increase in the movable metallic ion density in the dielectric layer 14, a barrier layer having a thickness of about several nm to several tens of nm may be provided between the bus electrodes 13 and the dielectric layer 14. Examples of the barrier layer include an SiON film and a TiN film.

The dielectric layer 14 consisting of the silicon oxide layer, in this embodiment, is formed by a sputtering method, as will be described later. The thickness of the dielectric layer 14 is not particularly limited, and, in this embodiment, is 1 to 10 $\mu$m, particularly not more than 7 $\mu$m. In this case, the electric field strength impressed on the dielectric layer 14 is not more than $30\times10^4$ V/cm.

By providing the dielectric layer 14, it is possible to prevent the ions or electrons generated in the discharge cells 4 from making direct contact with the discharge sustaining electrodes 12. As a result, wearing of the discharge sustaining electrodes 12 can be prevented. The dielectric layer 14 has a memory function for accumulating the wall charges generated in an address period and thereby maintaining a discharge condition, and a function as a resistor for restricting an excess discharge current.

The protective layer 15 provided on the surface of the dielectric layer 14 on the side of the discharge spaces shows the action of protecting the dielectric layer 14 and preventing the dielectric layer 14 from making direct contact with ions or electrons. As a result, wearing of the discharge sustaining electrodes 12 can be prevented effectively. In addition, the protective layer 15 also has the function of emitting secondary electrons necessary for electric discharge. Examples of the material for constituting the protective layer 15 include magnesium oxide (MgO), magnesium fluoride ($MgF_2$) and calcium fluoride ($CaF_2$). Among others, magnesium oxide is a preferable material having such characteristic features as, chemical stability, a low sputtering ratio, a high light transmittance at light emission wavelengths of the phosphor layers, and a low discharge start voltage. Incidentally, the protective layer 15 may have a laminate film structure composed of at least two materials selected from the group consisting of the just-mentioned materials.

Incidentally, a barrier layer having a thickness of about several nm to several tens of nm may be provided between the dielectric layer 14 and the protective layer 15, in order to suppress injection of carriers into the dielectric layer 14. The barrier layer is composed, for example, of an SiON film.

Examples of the materials for constituting the first substrate 11 and the second substrate 21 include high strain point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$). The materials constituting the first substrate 11 and the second substrate 21 may be the same or different, but it is preferable that both the materials have equal coefficients of thermal expansion.

The phosphor layers 25R, 25G, 25B are comprised, for example, of phosphor layer materials selected from the group consisting of phosphor layer materials for emitting red light, phosphor layer materials for emitting green light, and phosphor layer materials for emitting blue light, and are provided on the upper side of the address electrodes 22. In the case where the plasma display device is for color display, concretely, for example, the phosphor layer formed of a phosphor layer material for emitting red light (red phosphor layer 25R) is provided on one group of the address electrodes 22, the phosphor layer formed of a phosphor layer material for emitting green light (green phosphor layer 25G) is provided on another group of the address electrodes 22, and the phosphor layer formed of a phosphor layer material for emitting blue light (blue phosphor layer 25B) is provided on a further group of the address electrodes 22; the phosphor layers for emitting light in three primary colors constitute one set, and they are arranged in a predetermined order. As described above, the region in which one pair of the discharge sustaining electrodes 12 overlap with one set of the phosphor layers 25R, 25G, 25B for emitting light in three primary colors corresponds to one pixel. The red phosphor layer, the green phosphor layer, and the blue phosphor layer may be formed in a stripe form or may be formed in a lattice form.

As the phosphor layer materials for constituting the phosphor layers 25R, 25G, 25B, those phosphor layer materials which have a high quantum efficiency and show little saturation to vacuum UV rays can be appropriately selected from the conventionally known phosphor layer materials and be used. Where color display is presumed, it is preferable to combine the phosphor layer materials such that the color purities are close to the three primary colors specified by NTSC, a good white balance can be obtained upon mixture of three primary colors, the afterglow times are short, and the afterglow times of three primary colors are substantially equal.

Concrete examples of the phosphor layer materials are given below. Namely, examples of the phosphor layer material for emitting red light include ($Y_2O_3$:Eu), ($YBO_3$:Eu), ($YVO_4$:Eu), ($Y_{0.96}P_{0.60}V_{0.40}O_4$:$Eu_{0.04}$), [(Y,Gd)$BO_3$:Eu], ($GdBO_3$:Eu), ($ScBO_3$:Eu), and ($3.5MgO.0.5MgF_2.GeO_2$:Mn); examples of the phosphor layer material for emitting green light include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb), and ($Sr_4Si_3O_8Cl_4$:Eu); and examples of the phosphor layer material for emitting blue light include ($Y_2SiO_5$:Ce), ($CaWO_4$:Pb), $CaWO_4$, $YP_{0.85}V_{0.15}O_4$, ($BaMgAl_{14}O_{23}$:Eu) ($Sr_2P_2O_7$:Eu), and ($Sr_2P_2O_7$:Sn).

Examples of the method of forming the phosphor layers 25R, 25G, 25B include a thick film printing method, a method in which particles of the phosphor layer are sprayed, a method in which a sticky substance is preliminarily applied to planned areas for formation of the phosphor layer and particles of the phosphor layer are adhered to the sticky substance, a method in which a photosensitive phosphor layer paste is used and the phosphor layer is patterned by light exposure and development, and a method in which a phosphor layer is formed on the entire surface of the substrate and unnecessary portions of the phosphor layer are removed by sandblasting.

Incidentally, the phosphor layers 25R, 25G, 25B may be formed directly on the address electrodes 22, or may be formed over the area ranging from the regions on the address electrodes 22 to the regions on the side wall surfaces of the partition walls 24. Or, the phosphor layers 25R, 25G, 25B may be formed on the dielectric film provided on the address electrodes 22, or may be formed over the area ranging from the regions on the dielectric film 23 provided on the address electrodes 22 to the regions on the side wall surfaces of the partition walls 24. Further, the phosphor layers 25R, 25G, 25B may be formed only on the side wall surfaces of the partition walls 24. Examples of the material for constituting the dielectric film 23 include low melting point glass and $SiO_2$.

Incidentally, from the viewpoint of prevention of voltage fluctuation, also at the time of address discharge (data write discharge) by the address electrodes 22, it is preferable that the trap density or movable metallic ion density in the dielectric film 23 is not more than $1\times10^{18}$ pieces/$cm^3$, particularly not more than $\times10^{17}$ pieces/$cm^3$.

As has been described above, the second substrate 21 is provided with the partition walls (ribs) 24 extending in parallel to the address electrodes 22. Incidentally, the partition walls (ribs) 24 may have a meander structure. Where the dielectric film 23 is provided on the second substrate 21 and the address electrodes 22, the partition walls 24 are, in some cases, formed on the dielectric film. As the material for constituting the partition walls 24, conventionally known insulating materials can be used; for example, a material prepared by mixing a metallic oxide such as alumina into low melting point glass, which is widely used, can be used. The partition walls 24 have a width of not less than about 50 $\mu$m and a height of about 100 to 150 $\mu$m, for example. The pitch interval of the partition walls 24 is, for example, about 100 to 400 $\mu$m.

Examples of the method for forming the partition walls 24 include a screen printing method, a sandblasting method, a dry film method, and a photosensitivity method. The dry film method is a method in which a photosensitive film is laminated on a substrate, the photosensitive film in the planned areas for formation of the partition walls is removed by light exposure and development, the material for forming the partition walls is charged into the opening portions generated by the removal, and firing is conducted. The photosensitive film is burned away by the firing, and the partition wall forming material charged in the opening portions is left, to constitute the partition walls 24. The photosensitivity method is a method in which a layer of a photosensitive material for forming the partition walls is formed on a substrate, the material layer is patterned by light exposure and development, and then firing is conducted. Incidentally, the partition walls 24 may be blackened to form the so-called black matrix, whereby an enhancement of contrast of the display screen can be contrived. Examples of the method for blackening the partition walls 24 include a method in which the partition walls are formed by use of a color resist material which is colored in black.

One pair of the partition walls 24 provided on the second substrate 21, and the discharge sustaining electrode 12 and the address electrode 22 and the phosphor layer 25R, 25G, 25B which occupy the region surrounded by the one pair of the partition walls 24 constitute a single discharge cell. A discharge gas consisting of a mixture gas is sealed in the inside of such discharge cells, more specifically, in the inside of the discharge spaces surrounded by the partition walls, and the phosphor layers 25R, 25G, 25B emit light upon being irradiated with UV rays generated based on AC glow discharge generated in the discharge gas inside the discharge spaces 4.

Method of Producing Plasma Display Device

Next, a method of producing a plasma display device according to an embodiment of the present invention will be described.

A first panel 10 can be produced by the method as follows. First, an ITO layer is formed on the entire surface of a first substrate 11 formed of high strain point glass or soda glass by, for example, a sputtering method, and the ITO layer is patterned into a stripe form by photolithography technique and etching technique, whereby a plurality of pairs of discharge sustaining electrodes 12 are formed. The discharge sustaining electrodes 12 extend in a first direction.

Next, an aluminum film is formed over the whole area of the inside surface of the first substrate 11 by, for example, a vapor deposition method, and the aluminum film is patterned by photolithography technique and etching technique, whereby bus electrodes 13 are formed along an edge portion of each of the discharge sustaining electrodes 12. Thereafter, a dielectric layer 14 formed of silicon oxide ($SiO_2$) is formed over the whole area of the inside surface of the first substrate 11 provided with the bus electrodes 13.

It should be noted that, when a barrier layer is formed between the bus electrodes 13 and the dielectric layer 14, the barrier layer formed of silicon oxynitride (SiON) or the like is formed over the whole area of the inside surface of the first substrate 11 provided with the bus electrodes 13 before the dielectric layer 14 formed of silicon oxide ($SiO_2$) is formed over the whole area of the inside surface of the first substrate 11 provided with the barrier layer.

In this embodiment, the dielectric layer 14 is formed by use of a sputtering method, in which the partial pressure ($O_2/(Ar+O_2)$) of oxygen ($O_2$) gas in the atmosphere gas (containing Ar gas as main constituent) introduced into a sputtering apparatus is controlled to within the range of 1.5 to 40%, inclusive, so that the trap density in the dielectric layer 14 becomes not more than $1\times10^{17}$ pieces/$cm^3$. When the partial pressure of the oxygen gas during the sputtering is too low, the trap density in the silicon oxide film obtained tends to be higher; when the partial pressure is too high, on the other hand, film formation tends to be difficult to achieve.

Next, a protective layer 15 formed of magnesium oxide (MgO) and having a thickness of 0.6 $\mu$m is formed on the dielectric layer 14 by an electron beam vapor deposition method or a sputtering method. Incidentally, where a barrier layer is formed between the dielectric layer 14 and the protective layer 15, the barrier layer formed of SiON or the like is formed on the dielectric layer 14, and thereafter the protective layer 15 is formed thereon. By these steps, the first panel 10 can be completed.

A second panel 20 is produced by the method as follows. First, an aluminum fi m is formed on a second substrate 21 formed of high strain point glass or soda glass by, for example, a vapor deposition method, and the aluminum film is patterned by photolithography technique and etching technique, whereby address electrodes 22 are formed. The address electrodes 22 extend in a second direction orthogonal to the first direction. Next, a low melting point glass paste layer is formed on the entire surface by a screen printing method, and the low melting point glass paste layer is fired to form a dielectric film 23. Incidentally, the dielectric film 23 may also be formed by a method similar to that for the dielectric layer 14.

Thereafter, a low melting point glass paste is printed on the dielectric film 23 on the upper side of the regions between the adjacent address electrodes 22, by a screen printing method, for example. Thereafter, the second substrate 21 is fired in a firing furnace, to form partition walls 24. The firing (partition wall firing step) is conducted in air, at a firing temperature of about 560° C. The firing time is about 2 hours.

Next, phosphor layer slurries for three primary colors are sequentially printed between the partition walls 24 provided on the second substrate 21. Thereafter, the second substrate 21 is fired in a firing furnace, to form phosphor layers 25R, 25G, 25B over the areas ranging from the regions on the dielectric film between the partition walls 24 to the regions on side wall surfaces of the partition walls 24. The firing (phosphor firing step) is conducted at a temperature of about 510° C. The firing time is about 10 min.

Next, the plasma display device is assembled. Namely, first, a seal layer is formed on a peripheral portion of the second panel 20, by a screen printing method, for example. Next, the first panel 10 and the second panel 20 are laminated on each other, followed by firing to harden the seal layer. Thereafter, the spaces formed between the first panel 10 and the second panel 20 are evacuated, then a discharge gas is charged into the evacuated spaces, and the spaces are sealed off, thereby completing the plasma display device 2.

Now, one example of an AC glow discharge operation of the plasma display device constituted as above will be described. First, a panel voltage higher than a discharge start voltage Vbd is impressed for a short time on all the discharge sustaining electrodes 12 on one side. By this, glow discharge is generated, and electric charges of mutually opposite poles are adhered to the surfaces of the dielectric layer 14 in the vicinity of the discharge sustaining electrodes on both sides, whereby wall charges are accumulated, and an apparent discharge start voltage is lowered. Thereafter, while a voltage is impressed on the address electrodes 22, a voltage is impressed on the discharge sustaining electrodes 12 on one side contained in the discharge cells for non-display, whereby glow discharge is generated between the address electrodes 22 and the discharge sustaining electrodes 12 on one side, to eliminate the accumulated wall charges. The elimination discharge is sequentially carried out at each of the address electrodes 22. On the other hand, no voltage is impressed on the discharge sustaining electrodes on one side contained in the discharge cells for display. By this, the accumulation of the wall charges is maintained. Thereafter, a predetermined pulse voltage is impressed between all pairs of the discharge sustaining electrodes 12, whereby glow discharge is started between the pairs of the discharge sustaining electrodes 12 in the cells in which the wall charges have been accumulated. In this case, in the discharge cells, the phosphor layers excited by irradiation with vacuum UV rays generated based on the glow discharge in the discharge gas in the discharge spaces emit light in colors peculiar to the kinds of the phosphor layer materials. Incidentally, the phases of the discharge sustaining voltages impressed respectively on the discharge sustaining electrodes on one side and the discharge sustaining electrodes on the other side are staggered from each other by one half of a period, and the polarities of the electrodes are reversed according to the frequency of the AC.

In the plasma display device 2 and the method of producing the same according to the present embodiment, the trap density in the dielectric layer 14 is not more than a predetermined value; therefore, sputtering of the protective film due to the potential generated by the electrons trapped in the traps can be obviated, fluctuation of the discharge start voltage and lowering of the luminance would not easily occur, and reliability and life are enhanced.

Second Embodiment

In the above-described embodiment, the dielectric layer 14 composes of a single silicon oxide layer is formed by a sputtering method. However, in the present invention, the material properties of the layer and the film forming method therefor are not limited, as far as a dielectric layer having the trap density of not more than $1\times10^{17}$ pieces/cm$^3$ can be formed. In addition, in the present invention, the dielectric layer 14 may not necessarily be composes of a single silicon oxide layer, and may be composed of a multi-layer film.

Third Embodiment

In the present embodiment, in the plasma display device 2 shown in FIG. 1, the relationship between the trap density in the dielectric layer 14 and the fluctuation of discharge start voltage will be described in more detail.

Generally, a large number of defects are present in a dielectric layer. It is well known that, in a glass containing silicon dioxide as a main constituent, the kind of the defects on an electric basis is the electron trap, in analogy to the thermal oxide $SiO_2$ used for a MOS semiconductor. In the plasma display device, alkali metal- and alkaline earth-containing glasses containing silicon dioxide as a main constituent are in some cases used as an insulating material, on the discharge sustaining electrodes. In these glasses, components for controlling the melting point and dielectric constant, such as PbO, are also contained.

However, the discharge start voltage and the deterioration characteristics of the plasma display device differ greatly according to the material properties of the film. The reason for this is considered to be that electric charges are trapped in the defects, i.e., traps present in the dielectric layer, and the presence of the electric charges leads to the generation of a potential.

TABLE 1

| | $SiN_x$ | Film Dielectric | $SiO_2$ |
|---|---|---|---|
| Discharge Voltage (V) | 230 | 250 | 253 |

Table 1 shows the discharge voltage in silicon nitride, silicon oxide, and a film dielectric. The discharge gap is 20 μm, and the discharge gas is Xe at a pressure of 30 kPa. Silicon nitride is known to have a high electron trap density, which is about $2\times10^{18}$ pieces/cm$^3$. In general, the electron trap density in a thermal oxide film of Si in terms of sheet density is not more than $10^{10}$ pieces/cm$^2$; in the cases where the film is formed by vapor deposition, sputtering, low temperature CVD, low melting point glass firing, or the like, the electron trap density is considered to be in the range of about $1\times10^{15}$ to $1\times10^{18}$ pieces/cm$^3$ (from $1\times10^{10}$ to $1\times10^{12}$ pieces/cm$^2$ in terms of sheet density).

In view of the above, the influences of the electron traps on a silicon nitride dielectric film formed on the discharge sustaining electrodes in the plasma display device will be estimated (GENDAI HANDOHTAI DEBAISU NO KISO (Fundamentals of Modern Semiconductor Devices), written by Seigoh Kishino, Ohmsha, Ltd., 1995). Estimation is made based on the assumption that $1\times10^{18}$ pieces/cm$^3$ of electric charges are present in the dielectric layer, and, where the thickness of the dielectric layer 14 is 10 μm, it is assumed that all the traps are equivalently present just at the middle of the thickness, i.e., 5 μm, of the dielectric layer 14. Then, the sheet electron trap density is $1\times10^{12}$ pieces/cm$^2$. Where the trap occupation factor of the electrons trapped in the traps is 0.5, $5\times10^{11}$ pieces/cm$^2$ of electrons are present at this depth. Since MgO is present as the protective layer 15 between the dielectric layer 14 and the discharge gas, the effect of this is taken into account with the relative dielectric constant being $\in=10$, the electric potential generated by the sheet electric charges, i.e., the influence on the discharge gas in terms of voltage can be determined by the following formula:

$$V=-(1/C)Q \tag{1}$$

where 1/C=1/C1+1/C2, C1 is the capacity of the dielectric layer 14, and C2 is the capacity of the protective layer 15.

When individual numerical values (relative dielectric constant of silicon nitride: 7.9, relative dielectric constant of MgO: 10.0, film thickness: 0.6 μm) are put into the formula, $$C1=1.40\times10E-9\ F/\text{cm}^2,\ C2=14.4\times10E-9\ F/\text{cm}^2,$$

$$C=1.28\times10E-9\ F/\text{cm}^2,$$

$$Q=1.6\times10E-7\ C/\text{cm}^2,\ \text{and}$$

the voltage $V$ is $V=-125\ V$.

If this amount of electric charges is present on the pair of the discharge sustaining electrodes 12 and on the address electrode 22 in the same extent, the influences cancel each other.

Namely, $$V_{total}=Vx-Vy=-125-(-125)=0$$

where Vx is the potential generated by the electric charges injected into the traps on the side of the common-side sustaining electrode X on one side of the pair of discharge sustaining electrodes, and Vy is the potential generated by the electric charges injected into the traps on the side of the scan-side sustaining electrode Y on the other side.

However, in the case where the electrons trapped in the traps in the dielectric layer 4 are moved by the electric field strength to change the distribution thereof, the influences do not cancel each other. Namely, the distribution on the side of the scan-side sustaining electrode is moved by about 0.5 μm in the deeper direction as viewed from the discharge gas, and the distribution on the side of the common-side sustaining electrode is moved by about 0.5 μm in the shallower direction, scan-side sustaining electrode side Y: V1=−137 V, common-side sustaining electrode side X: V2=−113 V, and $$V_{total}=Vx-Vy=-137-(-113)=-24\ (V).$$

Thus, the influences do not cancel each other. Namely, apparently, the discharge start voltage seems to have been lowered. This may occur in the case where electric charges are injected into the dielectric layer 14 and trapped in the electron traps, due to aging or the like. Namely, in the case of a film having a very large number of traps, electric charges are trapped in the dielectric layer, and the discharge start voltage is lowered to below the original discharge start voltage.

On the other hand, when the diffusion of electric charges from the inside of the film to the outside of the film or the occupation distribution of the trapped electrons in the dielectric layer 14 is changed, the potential generated by the electric charges trapped in the traps varies. Namely, when the absolute value of the potential generated by the electric charges within the film is lowered, the differential between the scan side and the common side is reduced, and the discharge start voltage increases on an apparent basis. Then, when discharge is again generated, the electric charges are re-injected into the dielectric layer 14, whereby the discharge start voltage is lowered. FIG. 4 shows the results of examination of the fluctuation of the discharge start voltage with time, showing that the discharge start voltage is lowered with the lapse of time.

In order to obviate the influence of the potential generated by the electric charges in the dielectric layer 14, it is necessary to enhance the film quality of the dielectric layer and thereby to lower the original electron trap density in the dielectric layer 14. It is at least necessary to set the electron trap density to be not more than $1\times10^{17}$ pieces/cm$^3$; where the electron trap density is on this level, the influence of the injection of electrons can be lowered to or below ⅕ of the ordinary level.

Incidentally, the above discussion is based on the case where the thickness of the dielectric layer 14 is as small as a value of not more than about 10 $\mu$m and the electric field strength is not more than $30\times10^4$ V/cm. On the other hand, the same object can be attained also by suppressing the fluctuation of electric charge distribution due to the electric field strength impressed on the dielectric layer 14. Namely, the means is to enlarge the film thickness of the dielectric layer 14 and to reduce the electric field strength to or below $7\times10^4$ V/cm. Concretely, in the case where the problem is generated when the relative dielectric constant of the dielectric layer 14 is $\in$=4.0 and the thickness is 10 $\mu$m, for example, a low melting point glass having a dielectric constant of about 12 may be used and the thickness may be increased to 3 times the original value, whereby the electric field strength is reduced to ⅓ of the original value while the capacity remains unchanged, and the voltage fluctuation can be suppressed accordingly. Since the electric field strength is reduced, the amount of the electric charges injected into the dielectric layer 14 can itself be reduced largely, so that the problem can be improved. The above-mentioned mechanism is considered to be one cause of the burning phenomenon at specified locations on the screen in the plasma display device, and, therefore, the above-mentioned measure shows an improving method as to film quality and film thickness of the dielectric layer 14.

According to the plasma display device according to the present embodiment, the film quality of the dielectric layer 14 laminated on the discharge sustaining electrodes 12 and the bus electrodes 13 is improved, whereby the fluctuation of the discharge start voltage, i.e., the fluctuation of the driving voltage can be restrained, and a long-term reliability can be secured. In addition, voltage fluctuation at specified locations, which is considered to be one cause of the burning phenomenon, can also be restrained.

Other Embodiments

The present invention is not limited to the above-described embodiments, and various modifications are possible within the scope of the present invention.

For example, in the present invention, the concrete structure of the plasma display device is not limited to the embodiment shown in FIG. 1, and other structures may be adopted. For example, while the so-called three-electrode type plasma display device has been shown as an example in the embodiment shown in FIG. 1, the plasma display device according to the present invention may be the so-called two-electrode type plasma display device. In this case, one of each pair of discharge sustaining electrodes is provided on the first substrate, and the other is provided on the second substrate. In addition, the projection images of the discharge sustaining electrodes on one side extend in a first direction, and the projection images of the discharge sustaining electrodes on the other side extend in a second direction different from the first direction (preferably, roughly orthogonal to the first direction), and the pairs of the discharge sustaining electrodes are oppositely disposed so as to face each other. In the case of the two-electrode type plasma display device, if required, the term "address electrodes" in the description of the above-described embodiments should be read as "the discharge sustaining electrodes on the other side".

Besides, while the plasma display device in the above-described embodiments is the so-called reflection type plasma display device in which the first panel 10 is on the display panel side, the plasma display device according to the present invention may be the so-called transmission type plasma display device. In the transmission type plasma display device, the light emission of the phosphor layers is observed through the second panel 20; therefore although the conductive material constituting the discharge sustaining electrodes may be either transparent or opaque, the address electrodes 22 must be transparent because they are provided on the second substrate 21.

Now, the present invention will be described below based on more detailed examples, but the present invention is not limited to the examples.

Actual Example 1

A first panel 10 was produced by the method as follows. First, an ITO layer was formed by a sputtering method, for example, on the entire surface of a first substrate 11 formed of a high strain point glass or a soda glass, and the ITO layer was patterned into a stripe form by photolithography technique and etching technique, whereby a plurality of pairs of discharge sustaining electrodes 12 were formed.

Next, an aluminum film was formed on the entire surface of the inside surface of the first substrate 11 by, for example, a vapor deposition method, and the aluminum film was patterned by photolithography technique and etching technique, to form bus electrodes 13 along an edge portion of each of the discharge sustaining electrodes 12.

Thereafter, a dielectric layer 14 composed of a silicon oxide ($SiO_{2-x}$ ($0\leqq x<1.0$)) layer was formed on the entire surface of the inside surface of the first substrate 11 provided with the bus electrodes 13. The dielectric layer 14 was formed by use of an RF sputtering method using an $SiO_2$ target, in which the partial pressure ($O_2/(Ar+O_2)$) of oxygen ($O_2$) gas in the atmosphere gas (containing Ar gas as a main constituent) introduced into a sputtering apparatus was controlled to be 20%, which is not less than 15%. In addition, the RF power in the sputtering was 900 W, the Ar partial pressure was $3.3\times10^{-1}$ Pa, and the film forming rate was 0.12 $\mu$m/hr.

The thickness of the silicon oxide ($SiO_{2-x}$ ($0\leqq x<1.0$) layer was about 6 $\mu$m. The trap density of the silicon oxide layer was measured, and it was confirmed that the thickness was $5\times10^{16}$ pieces/cm$^3$, which is not more than $1\times10^{17}$ pieces/cm$^3$. The trap density was examined from a hysteresis by bias application of CV measurement for metal/insulating film/semiconductor structures, based on E. Suzuki, IEEE Trans. Electron Device ED-30 (2), 122 (1983).

Next, a protective layer 15 formed of magnesium oxide (MgO) and having a thickness of 0.6 μm was formed on the dielectric layer 14 consisting of the silicon oxide layer by an electron beam vapor deposition method. By the above steps, the first panel 10 could be completed.

A second panel 20 was produced by the method as follows. First, address electrodes 22 were formed on a second substrate 21 formed of a high strain point glass or a soda glass. The address electrodes 22 extend in a second direction orthogonal to the first direction. Next, a low melting point glass paste layer was formed on the entire surface by a screen printing method, and the low melting point glass paste layer was fired, to form a dielectric film.

Thereafter, a low melting point glass paste was printed on the dielectric film on the upper side of the regions between the adjacent address electrodes 22, by a screen printing method, for example. Thereafter, the second substrate 21 was fired in a firing furnace, whereby partition walls 24 were formed. The firing (partition wall firing step) was conducted in air, the firing temperature was about 560° C., and the firing time was about 2 hours.

Next, phosphor layer slurries for three primary colors were sequentially printed on the regions between the partition walls 24 provided on the second substrate 21. Thereafter, the second substrate 21 was fired in a firing furnace, to form phosphor layers 25R, 25G, 25B over the areas ranging from the regions on the dielectric film between the partition walls 24 to the regions on the side wall surfaces of the partition walls 24. The firing was conducted at 510° C. for 10 min, to complete the second panel 20.

Next, a plasma display device was assembled. Namely, first, a seal layer was formed on a peripheral portion of the second panel 20 by screen printing. Next, the first panel 10 and the second panel 20 were laminated on each other, followed by firing to harden the seal layer. Thereafter, the spaces formed between the first panel 10 and the second panel 20 were evacuated, a discharge gas was charged into the evacuated spaces, and the spaces were sealed off, to complete the plasma display device 2. As the discharge gas, 100% of Xe was used at a pressure of 30 kPa.

As to the plasma display device 2 thus obtained, a luminance deterioration test and a voltage life characteristic test were conducted by impressing a repeating driving pulse of 64 kHz at a driving voltage of 230 V. The results are shown in FIGS. 2 and 3. The measurement of luminance was conducted based on the television receiver test method according to JIS C6101-1988.

Comparative Example 1

A plasma display device was produced in the same manner as in Actual Example 1, except that the dielectric layer 14 was formed by a sputtering method using $Si_3N_4$ as a target so that the film constitution of the dielectric film would be $Si_xN_y$, under the sputtering conditions of an RF power of 900 W, an Ar partial pressure of $3.0\times10^{-1}$ Pa, and a film forming rate of 0.45 μm/hr. Then, the same measurements as in Actual Example 1 were conducted, except that the driving voltage was 175 V.

The trap density in the dielectric layer 14 was found to be $2\times10^{18}$ pieces/cm$^3$. The results of the luminance deterioration test and the voltage life characteristic test are shown in FIGS. 2 and 3.

Actual Example 2

A plasma display device was assembled in the same manner as in Actual Example 1, except that the silicon oxide layer constituting the dielectric layer 14 was formed by a plasma CVD method using $SiH_4$ and $N_2O$ as materials. When the same tests as in Actual Example 1 were conducted, the results similar to those in Actual Example 1 were obtained. The trap density in the dielectric layer in this example was $1\times10^{16}$ pieces/cm$^3$.

Actual Example 3

A plasma display device was produced in the same manner as in Actual Example 1, except that the dielectric layer 14 was formed by CVD using $SiH_4$ and $NH_3$+$N_2O$ so that the film constitution of the dielectric layer 14 would be SiON. The same measurements as in Actual Example 1 were conducted, except that the driving voltage was 210 V.

The trap density in the dielectric layer 14 was $1\times10^{17}$ pieces/cm$^3$. The results of luminance deterioration test and voltage life characteristic test were similar to those in Actual Example 1.

Comparative Example 2

A plasma display device was produced in the same manner as in Actual Example 1, except that the dielectric layer 14 was formed by a sputtering method using an $SiO_2$ target under the sputtering conditions of an RF power of 900 W, an Ar partial pressure of $3.3\times10^{-1}$ Pa, and a film forming rate of 0.5 μm/hr so that the trap density in the dielectric layer 14 would be higher than $1\times10^{17}$ pieces/cm$^3$. The same measurements as in Actual Example 1 were conducted, except that the driving voltage was 160 V.

The trap density of the dielectric layer 14 was measured to be $1.5\times10^{18}$ pieces/cm$^3$. The results of luminance deterioration test and voltage life characteristic test were similar to those in Comparative Example 1.

Evaluation 1

As shown in FIG. 2, it was confirmed that in Actual Example 1 (and in Examples 2 and 3, too), the deterioration of luminance with time is less and a more stable luminance can be obtained, as compared to Comparative Example 1 (and to Comparative Example 2, too). Also, as shown in FIG. 3, it was confirmed that in Actual Example 1 (and in Examples 2 and 3, too), the dispersion of the discharge start voltage with time is less and the voltage life characteristic is enhanced, as compared to Comparative Example 1 (and to Comparative Example 2, too). From these results, it was confirmed that when the trap density in the dielectric layer is set to be not more than $1\times10^{18}$ pieces/cm$^3$, particularly not more than $1\times10^{17}$ pieces/cm$^3$, fluctuation of the discharge start voltage and lowering of the luminance would not easily occur, and reliability and life of the plasma display device are enhanced.

Actual Example 4

A plasma display device was assembled in the same manner as in Actual Example 1, except that a silicon oxide layer having the trap density of $1.2\pm0.5\times10^{17}$ pieces/cm$^3$ was used as the dielectric layer 14. A voltage life characteristic test (life test) was conducted by impressing the electric field strength of $20\times10^4$ V/cm on the dielectric layer 14 of the plasma display device. The results are shown in FIG. 5. FIG. 5 shows the relationship between life test time and discharge start voltage.

Comparative Example 3

A plasma display device was assembled in the same manner as in Actual Example 1, except that a silicon oxide layer having the trap density of $1.2\pm0.5\times10^{18}$ pieces/cm$^3$ was used as the dielectric layer 14. A voltage life characteristic test (life test) was conducted in the same manner as in Actual Example 1, except that the electric field strength of $6\times10^4$ V/cm was impressed on the dielectric layer 14 of the plasma display device. The results are shown in FIG. 5. FIG. 5 shows the relationship between life test time and discharge start voltage.

Evaluation 2

As shown in FIG. 5, it was confirmed that in Actual Example 4 in which the silicon oxide layer with less oxygen deficiency (lower trap density) was used as the dielectric layer 14, a life time of not less than 4000 hours could be obtained, not withstanding the electric field strength is higher than that in Comparative Example 3, as compared to Comparative Example 3 in which the silicon oxide layer with more oxygen deficiency (higher trap density) was used as the dielectric layer 14. In contrast, in Comparative Example 3, the life time was 1000 hours, which is shorter than that in Actual Example 4.

Incidentally, in Comparative Example 3, the relationship between electric field strength versus life time was determined by varying the electric field strength from $6\times10^4$ V/cm to $21\times10^4$ V/cm. The results are shown in FIG. 6. As shown in FIG. 6, it was confirmed that the life time is shorter as the electric field impressed on the dielectric layer 14 is stronger.

From these, it can be confirmed that the life time can be prolonged if the electric field strength is weak, even though the trap density in the dielectric layer is high. As shown in FIG. 7, the present inventors have experimentally confirmed that the life time of the plasma display device is prolonged to a satisfactory extent when the relationship between trap density N and electric field strength E satisfies the following expression (1) under the condition where the trap density N is not more than $1\times10^{18}$ pieces/cm$^3$:

$$\text{Log } N \leqq -E\cdot10^{-4}/23+18+7/23 \quad (1)$$

As has been described above, according to the present invention, it is possible to provide a plasma display device such that fluctuation of discharge start voltage and lowering of luminance would not easily occur, the burning phenomenon of the screen is suppressed, and excellent reliability and long life can be secured, and a method of producing the same.

The invention claimed is:

1. A plasma display device comprising:

a first panel provided with a discharge sustaining electrode and a dielectric layer on the inside thereof, and a second panel laminated on said first panel so that a discharge space is formed on the inside of said first panel, wherein the trap density in said dielectric layer is not more than $1\times10^{18}$ pieces/cm$^3$.

2. A plasma display device comprising:

a first panel provided with a discharge sustaining electrode and a dielectric layer on the inside thereof, and a second panel laminated on said first panel so that a discharge space is formed on the inside of said first panel, wherein the movable metallic ion density in said dielectric layer is not more than $1\times10^{18}$ pieces/cm$^3$.

3. A plasma display device as set forth in claim 1 or 2, wherein the electric field strength impressed on said dielectric layer is not more than $7\times10^4$ V/cm.

4. A plasma display device as set forth in claim 1 or 2, satisfying the following relational expression (1):

$$\text{Log } N \leqq -E\cdot10^{-4}/23+18+7/23 \quad (1)$$

where E is the electric field strength impressed on said dielectric layer, and N is the trap density or movable metallic ion density in said dielectric layer.

5. A plasma display device as set forth in claim 2, wherein the movable metallic ion density in said dielectric layer is not more than $1\times10^{17}$ pieces/cm$^3$.

6. A plasma display device as set forth in any one of claim 1 or 2, wherein a bus electrode is provided along the longitudinal direction of said discharge sustaining electrode, and a barrier layer having a thickness of several nm to several tens of nm is provided between said bus electrode and said dielectric layer so as to prevent diffusion of metal from said bus electrode into said dielectric layer.

7. A plasma display device as set forth in any one of claim 1 or 2, wherein a protective film is provided on the surface of said dielectric layer on the side of said discharge space, and a barrier layer having a thickness of several nm to several tens of nm is provided between said dielectric layer and said protective film so as to suppress injection of a carrier into said dielectric layer.

8. A plasma display device as set forth in claim 1, wherein the trap density in said dielectric layer is not more than $1\times10^{17}$ pieces/cm$^3$.

9. A plasma display device as set forth in claim 8, wherein the trap density in said dielectric layer is not more than $5\times10^{16}$ pieces/cm$^3$.

10. A plasma display device as set forth in claim 8, wherein the trap density in said dielectric layer is not more than $1\times10^{17}$ pieces/cm$^3$ and not less than $1\times10^9$ pieces/cm$^3$.

11. A plasma display device as set forth in any one of claims 5 and 8 to 10, wherein the electric field strength impressed on said dielectric layer is not more than $30\times10^4$ V/cm.

12. A plasma display device as set forth in any one of claim 1 or 2, wherein said dielectric layer is an $SiO_{2-x}$ (where x is in the range of $0\leqq x<1.0$) film formed by a vacuum film forming method.

13. A plasma display device as set forth in any one of claim 1 or 2, wherein said dielectric layer is a nitrogen-containing silicon oxide (SiON) film formed by a vacuum film forming method.

14. A plasma display device as set forth in any one of claim 1 or 2, wherein said dielectric layer is a glass paste dielectric film formed by a coating method, a printing method or a dry film method, followed by firing.

15. A plasma display device as set forth in any one of claim 1 or 2, wherein said dielectric layer is an oxide or nitride dielectric film formed by a chemical vapor phase method.

16. A plasma display device as set forth in any one of claim 1 or 2, wherein said dielectric layer is a nitrogen-containing oxide dielectric film formed by a chemical vapor phase method.

17. A plasma display device of the AC driving type as set forth in any one of claims 1 to 16, wherein an address electrode, partition walls for partitioning said discharge space, and a phosphor layer disposed between said partition walls are provided on the inside of said second panel.

18. A plasma display device as set forth in claim 17, wherein a dielectric film is provided on the inside of said address electrode on the side of said discharge space, and the trap density of said dielectric film is not more than $1\times10^{18}$ pieces/$cm^3$.

19. A plasma display device as set forth in claim 17, wherein a dielectric film is provided on the inside of said address electrode on the side of said discharge space, and the movable metallic ion density in said dielectric film is not more than $1\times10^{18}$ pieces/$cm^3$.

20. A plasma display device as set forth in claim 19, wherein the electric field strength impressed on said dielectric film is not more than $7\times10^4$ V/cm.

21. A plasma display device as set forth in claim 19, satisfying the following relational expression (1):

$$\text{Log } N \leqq -E\cdot10^{-4}/23+18+7/23 \quad (1)$$

where E is the electric field strength impressed on said dielectric film, and N is the trap density or movable metallic ion density in said dielectric film.

22. A plasma display device as set forth in claim 18, wherein a dielectric film is provided on the inside of said address electrode on the side of said discharge space, and the trap density in said dielectric film is not more than $1\times10^{17}$ pieces/$cm^3$.

23. A plasma display device as set forth in claim 19, wherein a dielectric film is provided on the inside of said address electrode on the side of said discharge space, and the movable metallic ion density in said dielectric film is not more than $1\times10^{17}$ pieces/$cm^3$.

24. A plasma display device as set forth in claim 23, wherein the electric field strength impressed on said dielectric layer is not more than $30\times10^4$ V/cm.

* * * * *

UNITED STATES PATENT AND TRADEMARK OFFICE

CERTIFICATE OF CORRECTION

PATENT NO. : 7,002,295 B2
APPLICATION NO. : 10/398908
DATED : February 21, 2006
INVENTOR(S) : Shigeru Kujima et al.

It is certified that error appears in the above-identified patent and that said Letters Patent is hereby corrected as shown below:

In Column 20:
Line 67, "to 16," should be read as -- to 2, --.

Signed and Sealed this

Thirtieth Day of January, 2007

JON W. DUDAS
*Director of the United States Patent and Trademark Office*